United States Patent [19]

Wright et al.

[11] 3,970,551

[45] July 20, 1976

[54] GOLD SEPARATOR

[76] Inventors: Mynie L. Wright; Theodore H. Wright, both of 5617 E. Commerce, Spokane, Wash. 99206

[22] Filed: Apr. 23, 1975

[21] Appl. No.: 570,756

[52] U.S. Cl. ..... 209/458; 209/437; 209/485; 209/506

[51] Int. Cl.[2] ..... B03B 5/26

[58] Field of Search ..... 209/434, 437, 440–443, 209/458–460, 471, 472, 477, 485, 479–481, 506, 503, 504, 445, 446; 138/121, 129, 154, 27

[56] References Cited

UNITED STATES PATENTS

| | | | |
|---|---|---|---|
| 165,462 | 7/1875 | White | 209/442 |
| 398,475 | 2/1889 | Van Derveer | 209/437 |
| 496,391 | 5/1893 | Bair | 209/437 X |
| 569,113 | 10/1896 | Miller | 209/437 |
| 752,926 | 2/1904 | Schmitz | 209/437 |
| 2,222,777 | 11/1940 | Linke | 209/446 |
| 2,608,299 | 8/1952 | Huelsdonk | 209/503 X |
| 3,650,402 | 3/1972 | Caldwell | 209/430 |

FOREIGN PATENTS OR APPLICATIONS

| | | | |
|---|---|---|---|
| 69,770 | 7/1893 | Germany | 209/437 |

*Primary Examiner*—Frank W. Lutter
*Assistant Examiner*—Ralph J. Hill
*Attorney, Agent, or Firm*—Wells, St. John & Roberts

[57] ABSTRACT

A gold sluice includes an elongated semicylindrical trough having angular corrugations therein for imparting a longitudinal turbulent flow to water moving gravitationally therethrough. The longitudinal spiral turbulence of the water promotes separation of heavy particles from a placer material placed at an upstream end of the trough. Gold, being a heavy metal, will settle into the corrugation grooves along the trough. The sluice further includes laterally projecting flanges on opposite longitudinal side edges of the trough for preventing the trough from overturning laterally. The sluice is formed of a single sheet of lightweight material with the semicylindrical trough extending integrally therein and with the corrugations formed integrally within the trough. The corrugations are angularly oriented with respect to the longitudinal axis of the semicylindrical trough configuration.

3 Claims, 4 Drawing Figures

FIG 4
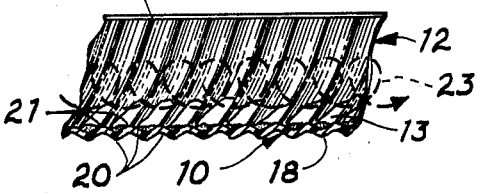
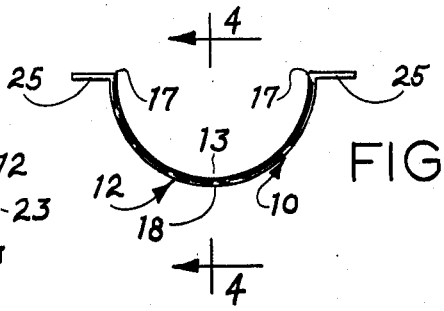
FIG 1
FIG 2
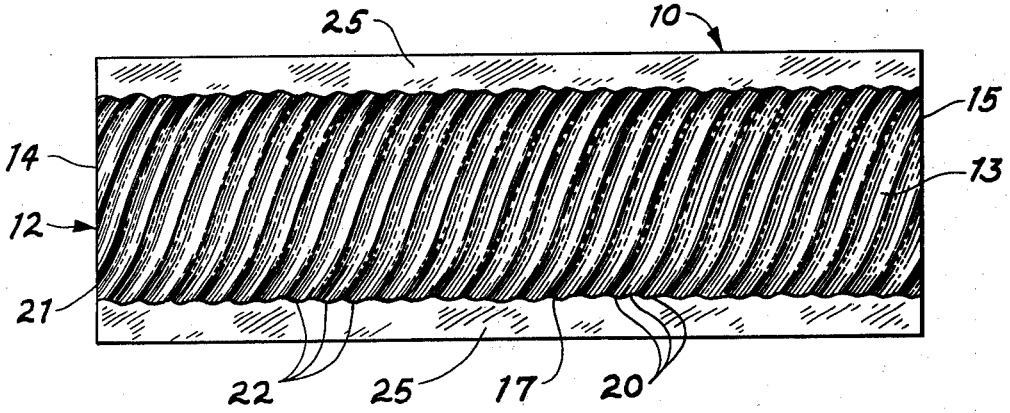
FIG 3
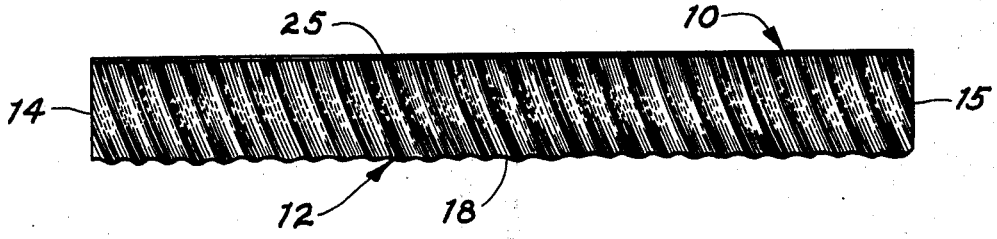

GOLD SEPARATOR

BACKGROUND OF THE INVENTION

The present invention is related basically to apparatus for separating a heavier solid ore material from a random mixture and more particularly to such devices utilized to separate gold from a placer material by passing a turbulent water flow over the material and collecting the heavier material that settles while the remainder of the material is carried away in the current.

It has long been desirable to obtain a simple, easy to operate, and inexpensive sluice for separating gold from placer material. Many such devices have been designed and utilized with varying degrees of success. However, most such devices are of a somewhat permanent nature in that they are bulky and require a stationary base with a movable sluice or trough mounted thereon. Water and placer are delivered separately to the sluice which is held adjacent to and possibly fed by a nearby source of water. Ordinarily, the sluice must be moved in order to gradually sift the placer from an input end of the trough toward an outlet where water and waste placer mixture is discharged. In order to provide such a continuous motion to the trough, a power means must be supplied or the trough must be operated manually. Therefore, the sluice assembly is either bulky, complex and expensive; or is at the least, difficult to operate manually over extended periods of time.

U.S. Pat. No. 224,406 discloses a machine for washing, sizing, and amalgamating gold and silver. This device discloses a perforated conical housing having a complementary auger rotatably carried therein along a central axis. Placer material is fed into the enlarged end of the housing and is carried by the rotating auger toward the reduced end while being separated as it moves along.

Other sluice separators are similar to that shown by U.S. Pat. No. 398,475 granted to M. T. Van Derveer wherein an elongated trough is provided with ridges extending transversely across the trough length for creating turbulence in water passing therethrough. A placer material is carried by the turbulent water along the trough so gold particles will settle into grooves between the ridges.

U.S. Pat. No. 496,391 discloses a gold separator wherein an elongated trough having a somewhat circular cross sectional configuration is utilized with longitudinal ribbing and a plurality of apertures formed through the trough.

The device of the present invention is substantially simpler in construction than the above described apparatus and includes only a single working element. Further, instead of producing a transverse turbulence in the water as it moves longitudinally in the trough, the present invention is intended to induce a somewhat longitudinally oriented spiral turbulence in the water as it moves along the trough. Such spiral turbulence has been found to most effectively separate heavier gold particles from the remainder of a placer material.

SUMMARY OF THE INVENTION

A gold sluice is described herein comprising an upwardly open elongated trough with an elongated open ended water passageway formed therein. The passageway is of generally circular cross sectional configuration and extends along a longitudinal central axis within the trough. Means is provided within the passageway that is integral with the trough for imparting longitudinal spiral turbulence to water moving along within the passageway and for progressively collecting gold sediment from placer material placed at an upstream trough end.

It is a primary object of the present invention to provide a gold sluice that is extremely simple in construction, lightweight in nature and is therefore very simple to operate and may be easily moved from one location to another.

A further object is to provide such a gold sluice that, instead of producing a transverse turbulence in water moving along, includes a trough portion that will impart a longitudinal spiral turbulence to the water moving therein to more efficiently separate gold particles from a placer material.

It is a still further object to provide such a sluice that is constructed of a single sheet of flexible material and is therefore simple and economical to manufacture.

These and still further objects and advantages will become apparent upon reading the following description which, taken with the accompanying drawings, set forth a preferred example of the present invention. It should be noted however that the drawings and following description are not intended to restrict the scope of the present invention, which is defined only by the appended claims.

BRIEF DESCRIPTION OF THE DRAWINGS

FIG. 1 is an end elevational view of the sluice;

FIG. 2 is a plan view looking down on the sluice;

FIG. 3 is a side elevational view; and

FIG. 4 is a sectioned view taken along line 4—4 in FIG. 1 showing diagrammatically the operation of our invention.

DETAILED DESCRIPTION OF A PREFERRED EMBODIMENT

A preferred form of the present invention is illustrated in the accompanying drawings and is designated therein by the reference character 10. The sluice 10 is basically comprised of a single sheet of flexible material such as plastic, formed into an elongated trough 12 that defines a longitudinal passageway 13 for water and placer. The trough 12 is upwardly open with longitudinally spaced ends 14 and 15 also open to receive and permit free flow of water therethrough.

It may be seen that the passageway 13 is substantially circular in cross section and semicylindrical along its length. The central longitudinal axis for passageway 13 and trough 12 lies within a plane passing through upper longitudinal edges 17 of trough 12. Trough 12 includes a bottom section 18 that is also curved in cross section.

As seen in FIGS. 1, 3 and 4, the trough 12 includes a plurality of longitudinally spaced corrugations 20. The corrugations 20 are comprised of a plurality of ridges 21 and interspaced grooves 22. The corrugations 20 are angularly oriented relative to the longitudinal axis or center of the circular trough and passageway. This angular relationship of corrugations 20 induces a longitudinally spiral turbulence to water as it moves gravitationally along the passageway 13. This movement is indicated in FIG. 4 by the dashed line 23.

Trough 12 further includes laterally extending flanges 25 that are integral with the remainder of the sluice 10 and extend laterally from upper trough edges 17. Flanges 25 extend outwardly from trough 12 a distance to either side thereof sufficient to prevent it from being overturned laterally while in use. Flanges 25 also lend some rigidity to the otherwise rather flexible trough 12.

In operation, the sluice 10 is placed in or adjacent to a source of water. When utilized in a moving stream, the sluice may be placed directly on the stream bed with water flowing along the passageway 13. A placer mixture is then placed adjacent the end 14 or 15 that is oriented upstream from the remaining end. Water moving over the passageway 13 will become rather turbulent due to the angular orientation of the corrugations 20. This turbulence takes a longitudinal spiral configuration to wash over the placer mixture and lift lighter particles to move with the flow on down the length of passageway 13 to be discharged back into the main water course. Gold, by nature of its weight, settles within grooves 22 while the remaining placer material is washed away. The device 10 can also be utilized on dry land with water being carried to or supplied otherwise to one end of the trough 12, with the trough being inclined so the water will run gravitationally down passageway 13 and out the remaining trough end.

To further assist separation of gold from the placer material, the user may rock the trough back and forth on the rounded bottom side 18 (laterally about the central longitudinal axis of trough 12). This movement may serve to loosen the placer material while not adversely affecting the turbulent flow of water.

The foregoing description was given only by way of example, the present invention being defined only by the following claims.

What we claim is:

1. A gold sluice, comprising:

an upwardly open elongated trough having an elongated open ended water passageway formed therein of generally semicylindrical configuration extending from an open intake end along a longitudinal central axis to an open outlet end within said trough; and corrugations disposed angularly along said axis in a spiral configuration within the passageway and comprised of ridges and interspersed grooves formed integrally with said trough for imparting longitudinal spiral turbulence to water moving along said passageway and for progressively collecting gold sediment in the grooves from a placer material placed at the intake end.

2. The gold sluice as set out by claim 1 wherein said trough includes laterally projecting flanges at upper longitudinal trough edges extending outwardly from the trough in opposite directions.

3. The gold sluice as set out in claim 2 wherein the entire sluice including the trough and flanges is formed of a single sheet of a lightweight resilient material such as plastic.

* * * * *